United States Patent [19]

Kramer

[11] Patent Number: 4,506,700

[45] Date of Patent: Mar. 26, 1985

[54] POPPET VALVE WITH FLOAT FUNCTION

[75] Inventor: Kenneth D. Kramer, Waterloo, Iowa

[73] Assignee: Deere & Company, Moline, Ill.

[21] Appl. No.: 539,785

[22] Filed: Oct. 7, 1983

[51] Int. Cl.[3] ..... F15B 13/043

[52] U.S. Cl. ..... 137/596.16; 91/461; 91/464; 137/596.14; 137/596.18

[58] Field of Search ..... 91/457, 461, 464; 137/596.14, 596.16, 596.18

[56] References Cited

U.S. PATENT DOCUMENTS

| | | | |
|---|---|---|---|
| 3,587,630 | 6/1971 | Dike et al. . | |
| 4,437,385 | 3/1984 | Kramer et al. | 91/457 X |
| 4,461,314 | 7/1984 | Kramer | 137/106 |

FOREIGN PATENT DOCUMENTS

| | | | |
|---|---|---|---|
| 2076182 | 11/1981 | United Kingdom | 137/596.18 |

OTHER PUBLICATIONS

Control Concepts' Double-Piloted, 3-Way, Spool Module Check Valve.

Modular Controls' Valve Assembly, Normally Closed, 2-Way.

*Primary Examiner*—Gerald A. Michalsky

[57] ABSTRACT

A four-function valve for operating a 2-way hydraulic cylinder has a pair of solenoid-operated pilots. The valve also includes a pair of valve members and a pair of poppet members, all slidable within bores in a pair of hollow sleeves. The solenoid-operated pilot valves control pilot pressure communication to the valve members to control movement of the valve and poppet members. Each poppet member has a pair of seats, one engageable with a shoulder on the sleeve to control fluid flow between a pump and the cylinder, the other engageable with an end of the corresponding valve member to control fluid flow between a sump and the cylinder.

10 Claims, 1 Drawing Figure

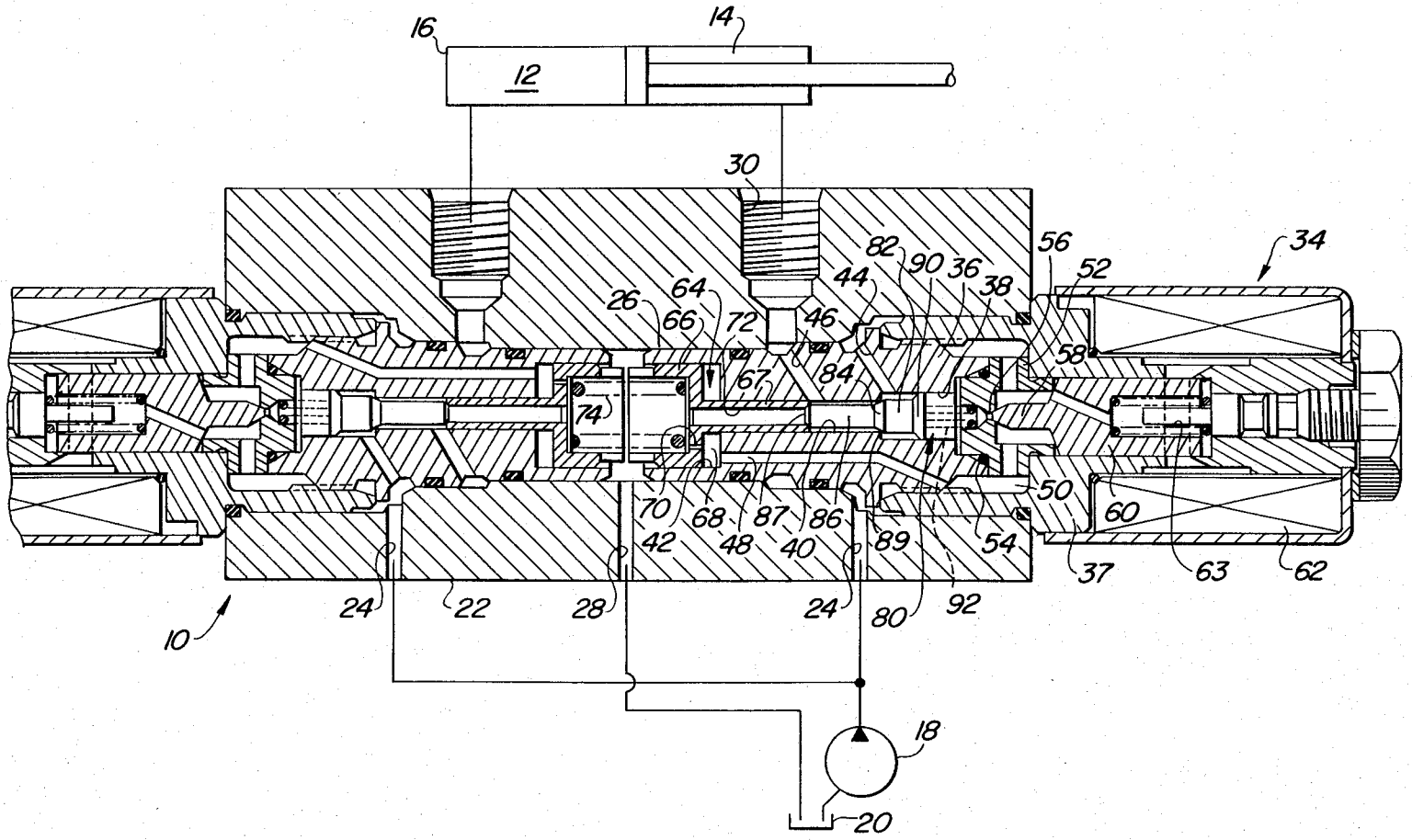
34
62
63
60
37
52
58
56
50
54
38
36
92
90
80
82
89
44
84
86
24
46
40
87
30
67
48
72
68
14
64
66
70
42
26
28
74
12
22
16
24
10
18
20

POPPET VALVE WITH FLOAT FUNCTION

BACKGROUND OF THE INVENTION

This invention relates to an electrohydraulic valve, and in particular, to a solenoid-operated, poppet-type, four-way, four-position valve.

Conventional pressure-compensated flow control valves, such as described in U.S. Pat. No. 3,587,630, have spool-type directional control valves in series with load check valves. The spool valve elements perform the primary metering function while the poppets perform only secondary sealing or load checking functions. Because spool-type valves are susceptible to contaminants in the hydraulic fluid, it has been proposed to control double-acting hydraulic cylinders via on-off type poppet valves controlled by solenoid-operated pilot valves. For example, a four-function (off, extend, retract and float) valve is described in U.S. application, Ser. No. 364,373, filed Apr. 1, 1982, now U.S. Pat. No. 4,437,385. However, this valve requires four separate pilot controlling soleniods. An electrohydraulic valve with only two solenoids is described in U.S. application, Ser. No. 416,836, filed Sept. 13, 1982, now U.S. Pat. No. 4,461,314. However, this valve lacks a "float" function and thus, does not have full four-function capability.

SUMMARY OF THE INVENTION

An object of the present invention is to provide a four-function, poppet-type valve which is operable with only two solenoid-controlled pilots.

A further object of the present invention is to provide a poppet-type, solenoid-operated valve which provides low leakage in the "off" position.

Another object is to provide such a valve with a float mode wherein both load ports communicate with a reservoir.

These and other objects are achieved by the present four-function valve for controlling a double-acting hydraulic cylinder. The valve includes a pair of valve members and a pair of poppet members, all slidable within bores in a pair of hollow sleeves. A pair of solenoid-operated pilot valves control pilot pressure communication to the valve members to control movement of the valve and poppet members. Each poppet member has a pair of seats, one engageable with a shoulder on the sleeve to control fluid flow between a pump and the cylinder, the other engagable with an end of the corresponding valve member to control fluid flow between a sump and the cylinder.

BRIEF DESCRIPTION OF THE DRAWING

The sole FIGURE is a cross-sectional view of a valve constructed according to the present invention.

DETAILED DESCRIPTION

An electrohydraulic valve 10 controls fluid communication between working chambers 12 and 14 of double-acting cylinder 16 and a pump 18 and reservoir 20.

In the FIGURE, reference numerals are applied primarily to only the right half of valve 10 since the left and right halves of the valve 10 are identical. The valve 10 includes a housing 22 forming a pair of inlets 24 which communicate fluid from the pump 18 to bore 26 in housing 22. The housing 22 also forms a sump passage 28 which communicates a central portion of the bore 26 to the sump 20 and a pair of load ports 30 which communicate the bore 26 with the work chambers of the cylinder 16.

The ends of the housing bore 26 threadably receive a pair of solenoids 34. The bore 26 also receives inner housings or cartridges 36 which have ends threadably attached to a housing 37 of each solenoid. Each cartridge 36 includes stepped bores with bore portions 38, 40 and 42 extending therethrough. Each cartridge also includes passages 44, 46 and 48. Passage 44 connects inlet 24 with bore portion 38. Passage 46 connects work port 30 with bore portion 40. Passage 48 connects bore portion 42 with a chamber 50 enclosed by solenoid 34 and cartridge 36.

A valve member 52 is disposed in chamber 50 and is sealingly coupled to the end of cartridge 36 by O-ring seal 54. Valve member 52 has a pilot valve orifice 56. A poppet valve 58 is fixed to an armature 60 moved by the coil 62 of solenoid 34 and biased by spring 63 to seal pilot orifice 56.

The other end of the cartridge 36 receives a hollow valve member 64 which has a hollow cylindrical flange 66 slidably and sealingly received in bore portion 42. A hollow stem 67 extends axially from flange 66 and is slidably and sealingly received by bore portion 40. The valve member 64 and the cartridge 36 enclose a pilot chamber 68 communicated with chamber 50 by passage 48. A bleed orifice 70 extends through flange 66 and communicates pilot chamber 68 with sump port 28. A bore 72 through the stem 67 of valve member 64 is communicated with sump port 28. A single, centrally positioned spring 74 urges the two valve members 64 away from each other.

A poppet member 80 is also movable within the cartridge 36. Poppet member 80 has a body 82 with a chamfered portion 84 joined to a stem 86. The end of stem 86 is also chamfered to form a seat 87 which is sealingly engageable with the end of the stem 67 to form an outlet poppet valve. The chamfered portion 84 forms a seat which is sealingly engageable with a shoulder 89 which joins bore portions 38 and 40 to thereby form an inlet poppet valve. A flange 90 is slidable in bore portion 38 and engages a spring 92 which is biased to urge seats 84 and 87 into engagement with shoulder 89 and stem 67, respectively. The diameter of stem 86 is smaller than bore portion 40 so that fluid can easily flow from pump port 44 past stem 86. Similarly, there is sufficient clearance between flange 90 and the wall or bore portion 38 to permit fluid flow through bore portion 38 from pump port 44 to pilot orifice 56.

Mode of Operation

When both solenoids 34 are off, then both pilot valve orifices 56 will be closed by poppet valves 58 to prevent communication of pump pressure to pilot chamber 68 via passage 44, bore portion 38, pilot orifice 56, chamber 50 and passage 48. Bleed orifices 70 thus permit springs 74 and 92 to maintain valve members 64 and both poppet members 80 in the position shown so that both valve seats 84 and both valve seats 87 are closed. This blocks fluid communication between either the pump inlet 24 or the sump port 28 with the work ports 30. In this situation, a load relief function is provided in that too high a load pressure in work chamber 12 or 14 can move the valve member 64 away from seat 87, thus opening communication between the work port 30 and the sump port 28 via passage 46 and bore 72.

When it is desired to extend or retract the fluid motor 16, then one of the solenoids 34 is energized while the other remains off. For example, if the left-hand solenoid 34 is energized, then poppet valve 58 will open pilot orifice 56 and pump pressure will be communicated to pilot chamber 42 via passage 44, bore portion 38, pilot orifice 56, chamber 50 and passage 48. This causes both valve members 64 and the right-hand poppet member 80 to move to the right, viewing the FIGURE. This opens right-hand seat 84 and permits fluid to flow from pump 18 to work chamber 14. At the same time, this opens left-hand seat 87 and permits fluid to flow from work chamber 12 to sump 20. This causes the cylinder 16 to retract.

The cylinder 16 can be "floated" by energizing both solenoids 34. This pressurizes both pilot chambers 50 and both valve members 64 will move towards the center of the valve 10 and away from their respective seats 87, thus opening both work chambers 12 and 14 to the sump port 28 via the bores 72 through the valve members 64.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A valve for controlling fluid communication between a pump, a reservoir and a double-acting fluid motor, the valve comprising:

a housing having a valve bore therein, a pump port communicating with the valve bore, a sump port communicating with the valve bore and first and second load ports communicating with the valve bore;

first and second pressure-responsive valve members movable in the valve bore;

a first poppet member movable in the valve bore and having a first seat engageable with the first valve member to form a first outlet poppet valve for controlling fluid communication between the sump port and the first load port and having a second seat engageable with a wall of the valve bore to form a first inlet poppet valve for controlling fluid communication between the pump port and the first load port;

a second poppet member movable in the valve bore and having a third seat engageable with the second valve member to form a second outlet poppet valve for controlling fluid communication between the sump port and the second load port and having a fourth seat engageable with a wall of the valve bore to form a second inlet poppet valve for controlling fluid communication between the pump port and the second load port; and first and second pilot pressure generating means, each communicated with a respective one of the first and second valve members, and each for individually generating a pilot pressure signal which acts upon one of the valve members to move both valve members and one of the poppet members to open the outlet poppet valve associated with the one valve member and to open the inlet poppet valve associated with the other valve member, and for together generating pilot pressure signals which act upon both valve members to move both valve members to open only both outlet poppet valves.

2. The valve of claim 1, wherein:

each valve member is hollow to permit fluid flow from the corresponding load port to the sump port when the valve member is disengaged from the first seat of the corresponding poppet member.

3. The valve of claim 1, wherein:

a coupling spring is resiliently coupled between the valve members and is biased to urge the valve members away from each other.

4. The valve of claim 1, further comprising:

first and second spring members, each coupled between the housing and a corresponding one of the poppet members and biased to urge the poppet members towards each other.

5. The invention of claim 1, wherein the housing comprises:

first and second poppet chambers, each receiving one of the poppet members, each having one end communicated with the pump port and having another end communicated with the corresponding one of the load ports, a sump chamber receiving the valve members and having a central portion communicated with the sump port, a first bore extending between the sump chamber and the first poppet chamber, and a second bore extending between the sump chamber and the second poppet chamber; and each valve member comprising a hollow flange slidable in the sump chamber and a hollow stem sealingly and slidably received in a corresponding one of the bores, each hollow stem and flange forming a passage therein for communicating the sump chamber with one of the poppet chambers, each hollow stem and flange cooperating with the housing to form a pilot chamber isolated from the sump port and communicated with one of the first and second pilot pressure generating means, each valve member being movable in response to a pressure differential between its pilot chamber and the sump port.

6. The invention of claim 5, wherein:

each valve member has a bleed orifice communicating its pilot chamber with the sump port.

7. The invention of claim 5, wherein each pilot pressure generating means comprises:

a pilot passage extending between one of the pilot chambers and the pump port and a solenoid controlled valve for controlling flow through the pilot passage.

8. The invention of claim 5, wherein:

the first seat of each poppet member is engageable with an end of the hollow stem of the corresponding valve member.

9. The invention of claim 1, wherein:

each valve member is movable away from the corresponding poppet member in response to load pressure to relieve the load pressure to the sump port.

10. The invention of claim 9, wherein:

the relieved load pressure is communicated to the sump port via a bore which extends through the valve member.

* * * * *